US008590612B2

(12) United States Patent
Shampine

(10) Patent No.: US 8,590,612 B2
(45) Date of Patent: Nov. 26, 2013

(54) SYSTEM AND METHOD TO PROVIDE WELL SERVICE UNIT WITH INTEGRATED GAS DELIVERY

(75) Inventor: Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 360 days.

(21) Appl. No.: 12/427,045

(22) Filed: Apr. 21, 2009

(65) Prior Publication Data

US 2010/0263860 A1 Oct. 21, 2010

(51) Int. Cl.
*E21B 19/22* (2006.01)

(52) U.S. Cl.
USPC ..... 166/90.1; 166/77.1; 166/77.2

(58) Field of Classification Search
USPC ..... 166/90.1, 77.1, 77.2
See application file for complete search history.

(56) References Cited

U.S. PATENT DOCUMENTS

| | | | | |
|---|---|---|---|---|
| 3,313,346 | A | 4/1967 | Cross | |
| 4,476,923 | A | 10/1984 | Walling | |
| 4,863,991 | A | 9/1989 | Poppe | |
| 5,180,014 | A | 1/1993 | Cox | |
| 5,511,619 | A | 4/1996 | Jackson | |
| 5,667,369 | A | 9/1997 | Cholet | |
| 5,692,562 | A | 12/1997 | Squires | |
| 5,785,500 | A | 7/1998 | Leniek | |
| 5,941,311 | A | 8/1999 | Newton | |
| 6,220,358 | B1 | 4/2001 | Leniek | |
| 6,264,128 | B1 | 7/2001 | Shampine et al. | |
| 6,702,011 | B2 | 3/2004 | Crawford et al. | |
| 7,051,818 | B2 * | 5/2006 | Crawford et al. | 166/379 |
| 7,207,389 | B2 * | 4/2007 | Foster et al. | 166/302 |
| 2004/0244993 | A1 | 12/2004 | Crawford et al. | |
| 2008/0066915 | A1 | 3/2008 | Shampine | |
| 2008/0264649 | A1 * | 10/2008 | Crawford | 166/381 |

OTHER PUBLICATIONS

Wise Nonstop Nitrogen Service—Wise Well Intervention, a subsidiary of Production Enhancement Group, Inc.—http://www.wisewellintervention.com/nitrogenservices.html—downloaded Feb. 3, 2009.

Non-Final Office Action issued in related U.S. Appl. No. 11/555,427 on Feb. 18, 2009, 11 pages.

Non-Final Office Action issued in related U.S. Appl. No. 11/555,427 on Dec. 9, 2009, 8 pages.

Final Office Action issued in related U.S. Appl. No. 11/555,427 on May 12, 2010, 8 pages.

Non-Final Office Action issued in related U.S. Appl. No. 11/555,427 on Aug. 13, 2010, 8 pages.

Final Office Action issued in related U.S. Appl. No. 11/555,427 on Jan. 28, 2011, 8 pages.

Final Office Action issued in related U.S. Appl. No. 11/555,427 on May 5, 2011, 9 pages.

(Continued)

*Primary Examiner* — Giovanna Wright
(74) *Attorney, Agent, or Firm* — Michael Flynn

(57) ABSTRACT

A technique enables improved efficiency with respect to various coiled tubing and well servicing operations. The technique utilizes a combined mobile unit having several types of equipment combined into at least one transportable unit. The combined mobile unit may comprise a coiled tubing reel having coiled tubing, a well servicing system mounted to deliver material through the coiled tubing, and/or other well servicing components with the gas delivery system. The gas delivery system has a pressurized liquid gas vessel to deliver gas that can be used for well servicing operations, including purging material from coiled tubing.

18 Claims, 2 Drawing Sheets

(56) References Cited

OTHER PUBLICATIONS

Non-Final Office Action issued in related U.S. Appl. No. 11/555,427 on Oct. 6, 2011, 8 pages.
Final Office Action issued in related U.S. Appl. No. 11/555,427 on Jun. 21, 2012, 8 pages.
High Pressure Water Pumps, Dynaset [online]. Apr. 2005 [retrieved Nov. 30, 2009]. Retrieved from the Internet: <URL: HTTP://web.archive.org./web/20050408041340/www.dynaset.com/WWW/High-Pressure-Water.html.

* cited by examiner

SYSTEM AND METHOD TO PROVIDE WELL SERVICE UNIT WITH INTEGRATED GAS DELIVERY

BACKGROUND

When conducting coiled tubing services at a well site, almost all operations on the well are conducted while pumping some type of fluid. Consequently, one or more pumps are moved to the well site for almost every coiled tubing service job. Existing techniques often use separate vehicles to deliver well service systems and pumping units to the well site. Furthermore, each vehicle must meet weight limits that apply to the various public roads used for delivering equipment to the site.

In many coiled tubing servicing applications, fluids may be retained within the coiled tubing upon completion of the well service. However, the retained fluid adds extra weight which can be problematic if the vehicle is already close to the maximum weight threshold for the public road system. Also, the retained fluids may be detrimental to the inside of the coiled tubing. In many applications, a separate nitrogen pumping vehicle is sent to the well site for the sole purpose of purging fluid from the coiled tubing reel before transport. In other applications, one or more bottles (typically used in sets of six) of compressed nitrogen are separately delivered to the well site to perform the purging function. In another application, compressed air was used to purge the coiled tubing, but oxygen in air tends to be corrosive and reduces the effectiveness of corrosion preventing chemicals that are normally introduced into the coiled tubing reel when fluid is removed. Also, unless special equipment is used, the rate and pressure delivered is limited.

SUMMARY

In general, the present disclosure provides a system and methodology to improve a coiled tubing service operation. The technique utilizes a combined mobile unit that combines several types of equipment into at least one transportable unit. For example, the combined mobile unit may comprise coiled tubing on a coiled tubing reel and a well servicing unit/system mounted to deliver material through the coiled tubing. The combined mobile unit also comprises a gas delivery system to deliver a gas that can be used for downhole actions and/or purging of material from coiled tubing.

An embodiment of a system for use in coiled tubing services comprises at least one transport vehicle having a weight within the legal limits required for use on a public road system, the transport vehicle comprising, a reel of coiled tubing; and a gas delivery system to deliver high pressure gas, the gas delivery system comprising a gas vessel and a purging system to purge fluid from the coiled tubing, upon completion of a well operation, to remove weight and to enable transport along the public road system. Alternatively, the gas delivery system is able to deliver pressurized gas through the coiled tubing when the coiled tubing is deployed in a well. Alternatively, the gas delivery system comprises a cryogenic gas vessel and a pressure building coil coupled to the cryogenic gas vessel. The gas delivery system may comprise a liquid gas boiler coupled to the cryogenic gas vessel. The liquid gas boiler may utilize waste heat from an engine on the transport vehicle. The liquid gas boiler may utilize heat from well servicing fluids. The purging system may comprise a liquid gas pump coupled to the cryogenic gas vessel and the liquid gas boiler. Alternatively, the at least one transport vehicle comprises at least a pair of transport vehicles, one of the transport vehicles comprising the reel of coiled tubing and another one of the transport vehicles comprising the gas delivery system and an injector handling system. The purging system may be capable of pumping a well treatment. The purging system may comprise a back pressure valve to maintain a desired pressure in the liquid gas boiler.

In an embodiment, a method comprises providing at least one transportable structure, mounting a coiled tubing reel with coiled tubing on the at least one transportable structure, positioning a well servicing unit on the at least one transportable structure in cooperation with the coiled tubing, and locating a purging system on the at least one transportable structure in a manner that enables purging of the coiled tubing. Alternatively, positioning comprises positioning a well cementing unit. Alternatively, positioning comprises positioning a coiled tubing unit. Alternatively, positioning comprises positioning a fracturing system. Alternatively, the method further comprises delivering the gas at high pressure for performing at least one well services operation. Alternatively, locating comprises locating a heat exchanger and a pressure building coil coupled to a cryogenic gas vessel. Locating may further comprise locating a back pressure valve coupled to the cryogenic gas vessel to maintain a desired pressure in the heat exchanger. The heat exchanger may utilizes heat from well servicing fluids. Locating may comprise locating a purging system comprising a plurality of cryogenic gas vessels to enable refilling of a cryogenic gas vessel while another cryogenic gas vessel is used to purge fluid. Alternatively, the method further comprises forming the at least one transportable structure as part of a transport vehicle for use on a public road system, and maintaining the gross weight of the at least one transport vehicle, with coiled tubing reel, coiled tubing, well servicing unit and purging system, under the weight limits of the public road system.

BRIEF DESCRIPTION OF THE DRAWINGS

Certain embodiments will hereafter be described with reference to the accompanying drawings, wherein like reference numerals denote like elements, and.

DETAILED DESCRIPTION

Figure 1:
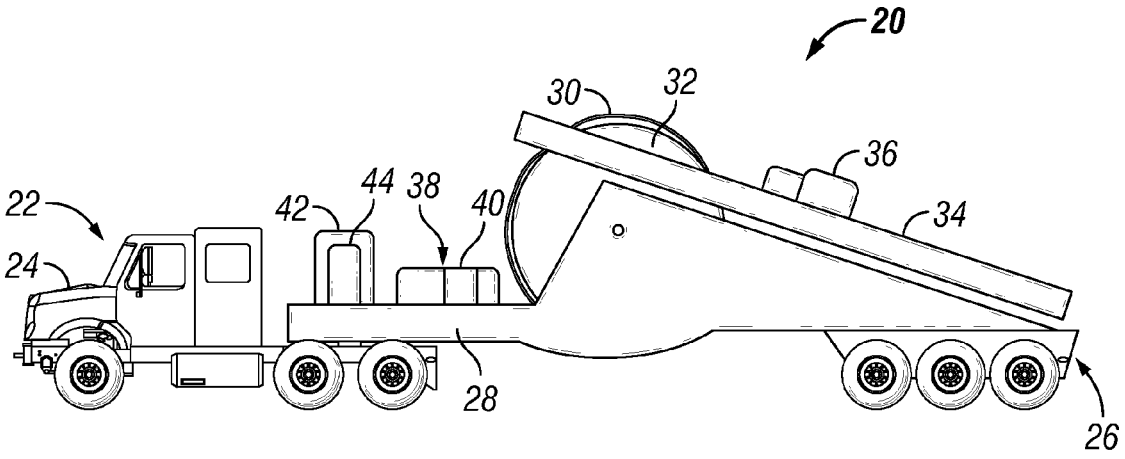
FIG. 1 is a schematic front elevation view of a transport unit having equipment used in coiled tubing servicing operations, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present disclosure generally relates to a system and methodology to facilitate coiled tubing service operations conducted at a well site. Generally, the system comprises an integrated transport unit designed to incorporate the functionality of a plurality of systems that would otherwise be transported to a given well site independently. The unique combination of systems and features improves the efficiency of transport from one well site to another, and the combination also can improve efficiency in carrying out the well servicing operation. By way of example, the system/components that can be combined and that are often present on a coiled tubing job may include: one or more tractors to move equipment over the road (the tractors also may provide power when parked); one or more deck engines to provide power if the tractor is not providing power; a coiled tubing reel; an injector; a blowout preventer (BOP) stack; a handling system that may comprise a crane, a mast, or other systems to position the injector and BOP stack on the well head; a fluid pumping system, such as a triplex pump; a fluid supply system that may include stationary tanks and/or tanker trailers; and a gas delivery system to deliver a desired gas, such as nitrogen, air, or another gas suitable for a specific application.

The present disclosure enables incorporation of the gas delivery system to form unique combinations of well service system components. According to one example, the gas delivery system is combined to create a transport unit/vehicle having a combination of tractor, coiled tubing reel, injector, BOP stack, handling system, and fluid pumping system. In another example, the gas delivery system is combined with the tractor, a coiled tubing reel, and an injector to form at least one transport unit. By way of further example, the gas delivery system is combined with a tractor and a coiled tubing reel. In an additional example, the gas delivery system is combined with a tractor, a BOP stack, and a handling system. By way of further example, the gas delivery system may be combined with a tractor, an injector, a BOP stack, and a handling system to form the at least one transport vehicle.

In an embodiment, the integrated transport unit comprises coiled tubing deployed on a coiled tubing reel and a fluid pumping system for delivering fluid through the coiled tubing to carry out a well servicing operation. By way of example, the fluid pumping system may comprise a pump powered by an engine, e.g. a deck engine, to deliver material downhole. Depending on the well servicing operation to be performed, the fluid pumping system may be used to deliver a cement slurry downhole, a fracturing fluid downhole, or another type of well service fluid downhole to a desired location. The integrated transport unit also comprises a gas delivery system designed to purge material, e.g. fluid, collected inside the coiled tubing after completion of the coiled tubing operation. Removal of material from the coiled tubing improves the life and functionality of the coiled tubing while reducing the weight of the overall integrated transport unit.

Referring generally to FIG. 1, an embodiment of an integrated transport unit 20 is illustrated. In this embodiment, integrated transport unit 20 is constructed as a transport vehicle 22, such as a truck designed for travel over public road systems. As a result, the transport vehicle 22 must comply with the weight limitations imposed by the governing authority on the public road system. The legal weight limitations may result from standard limits or specific limits obtained with permits. The well service systems described herein facilitate compliance with such legal limitations by enabling removal of unnecessary material, and thus weight, from the transport vehicle 22 prior to driving the vehicle over the public road system.

In the embodiment illustrated, transport vehicle 22 is illustrated as a semi-truck type vehicle having a tractor 24 designed to pull a trailer 26. The transport vehicle 22 creates a mobile unit that is readily moved from one well site to another via the public road system. The trailer 26 may comprise a platform 28 or other transportable structure on which a variety of systems and components are mounted to facilitate a given well servicing operation.

By way of example, the integrated transport unit 20 may comprise coiled tubing 30 mounted, e.g. spooled, onto a coiled tubing reel 32. Additionally, the unit may comprise a handling system 34 including, for example, a mast, boom, or crane and associated equipment 36 to facilitate delivery and retrieval of coiled tubing 30 into and out of a wellbore at a well site where a servicing operation is conducted. The integrated transfer unit 20 also may comprise a well servicing unit 38 which may be constructed with a variety of components and in a variety of configurations depending on the specific type or types of well servicing operations to be performed. By way of example, well servicing unit 38 may comprise a fluid pumping system 40 having a pump powered by a motive unit, such as a deck engine or other engine. The fluid pumping system 40 is designed to deliver pressurized fluid through the coiled tubing 30 when the coiled tubing is deployed in a well. In specific well servicing applications, the overall integrated transport unit 20 and its well servicing unit 38 may be constructed as a cementing unit, a fracturing system, a coiled tubing unit, or another system appropriate for the given servicing operations.

The integrated transport unit 20 further comprises a gas delivery system 42 which may be designed to deliver gas downhole and/or purge material from inside coiled tubing 30 to reduce the weight of the coiled tubing when spooled on coiled tubing reel 32. In some embodiments, the gas delivery system 42 employs pressurized gas to remove material, e.g. fluid, from coiled tubing 30. For example, gas delivery system 42 may comprise a pressurized tank system 44 that uses one or more liquid gas tanks to provide gas for purging material from the coiled tubing. In some applications, the gas delivery system 42 may be designed for delivering the purging material at well treatment pressures, thus allowing it to be used as part of the well treatment pumping system. In this embodiment, a pump is generally provided to increase the gas pressure significantly above that of the pressurized tank system 44.

Figure 2:
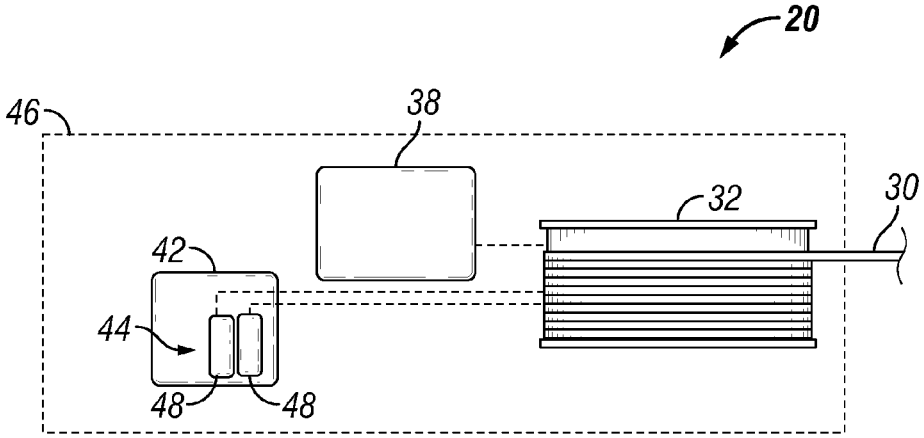
FIG. 2 is a schematic illustration of various components that can be incorporated into a transport unit, according to an embodiment of the present invention.

The arrangement of components and systems in integrated transport unit 20 can vary substantially depending on the type of well servicing operation to be performed, the environment in which the servicing operation is to be performed, design objectives with respect to the integrated transport unit, and on other factors. In FIG. 2, the integrated transport unit 20 is illustrated schematically to represent a variety of transportable structures 46. The transportable structure 46 may be designed as transport vehicle 22, but the transportable structure 46 also can be designed as an integrated unit for deployment to offshore platforms and vessels and to other locations not readily reached by tractor 24 and trailer 26.

In the schematic example illustrated in FIG. 2, the integrated well servicing systems may again comprise coiled tubing reel 32 with coiled tubing 30. Additionally, well servicing unit 38 may be a fluid pumping system operatively engaged with coiled tubing 30, and gas delivery system 42 may be used to purge material from coiled tubing 30. In this example, gas delivery system 42 comprises pressurized tank system 44 in a configuration that utilizes a plurality of liquid gas vessels or tanks 48. By way of example, liquid gas tanks 48 may comprise pressurized vessels, such as cryogenic gas vessels. In some embodiments, the cryogenic gas vessels are nitrogen vessels. It should be noted, however, that integrated transport unit 20 may comprise a variety of additional or alternate systems positioned on platform 28 or on other transportable structures while still enabling the integrated functionality. For example, the integrated transfer unit also may comprise an injector handling system 34, along with an injector and a BOP stack. However, the schematic of FIG. 2 also is representative of a variety of other component/system combinations, such as those discussed above. In an embodiment, the integrated transport unit 20 comprises a plurality of units 20. Those skilled in the art will appreciate that the coiled tubing reel 32 may be disposed on one of the units 20 and the gas delivery system 42 and/or the injector handling system 34 may disposed on another of the units 20. One of the units 20 may comprise a crane or mast, such as that shown in U.S. Pat. No. 6,264,128, for lifting and manipulating equipment, while another of the units 20 may comprise the coiled tubing reel 32. The units 20 may also comprise three or more transport units, wherein one of the units 20 comprises the coiled tubing reel 32, one of the units 20 comprises a crane, and one of the units 20 comprises a control trailer (comprising, for example, a controller (not shown) for controlling the operation of the coiled tubing reel 32 and/or crane) as will be appreciated by those skilled in the art.

Figure 3:
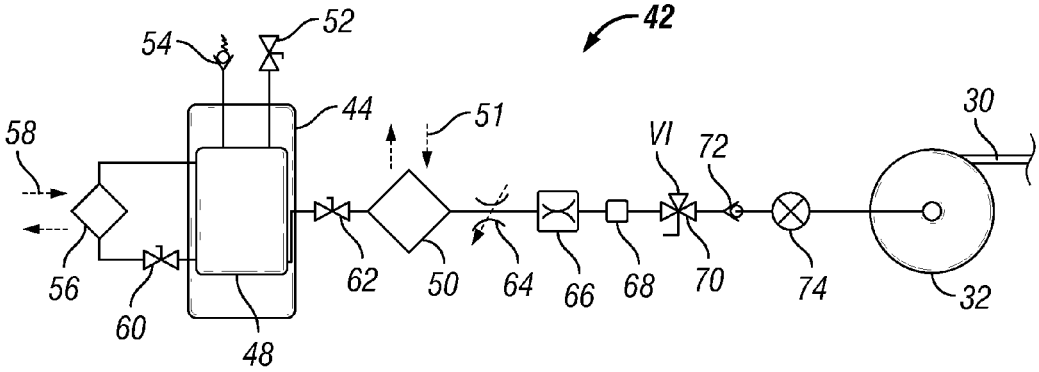
FIG. 3 is a schematic illustration of one embodiment of a gas delivery system that can be incorporated into the transport unit, according to an embodiment of the present invention.

Referring generally to FIG. 3, one embodiment of purging system 42 is illustrated. In this example, a cryogenic fluid, e.g. nitrogen, is pressurized significantly, and the tank pressure is used to deliver the fluid to a heat exchanger/liquid gas boiler where the fluid is boiled under pressure and then delivered to the application. The embodiment is suitable for blowing down coiled tubing, but the system also can be employed for purging of pipelines, vessels or other structures. This type of system can be designed to utilize one or more high-pressure tanks that are pressurized to, for example, 50 to 500 psi and 350 to 500 psi in certain applications. Individual liquid gas vessels 48 or a plurality of liquid gas vessels 48 (see FIG. 2) can be employed for purging unwanted material. For example, if two vessels are used, one liquid gas vessel 48 can be used to supply fluid at a desired pressure while the other vessel is filled. Once filled, the fluid delivery and fluid filling operations can be switched.

In the embodiment of FIG. 3, one or more high-pressure liquid gas vessels 48 are used to deliver fluid for purging coiled tubing or other tubing or vessels. The use of higher pressure liquid gas tanks/vessels can significantly reduce the complexity of cool down systems and/or provide a simplified cryogenic pumping system. It should be noted that with coiled tubing units, the hydraulic systems and/or engine coolant systems that are often employed with coiled tubing units can provide ready sources of heat for vaporizing small quantities of fluid, e.g. nitrogen. Such an approach also can be used to increase the power dissipating capabilities of the system by using the cryogen as a coolant and/or pumping it into the well. As described below, a valve also can be used on the outlet of the vaporizer/liquid gas boiler to ensure that the pressure is never less than a desired vaporizer pressure chosen to be compatible with the tank pressure and/or the pumping pressure. Such a valve can be referenced to absolute, outlet, or atmospheric pressure so that at higher delivered pressures the valve is fully open, but at pressures below the valve set pressure, the valve provides resistance to flow and increases the pressure in the vaporizer/liquid gas boiler.

Valves referenced to absolute or atmospheric pressure can improve the function of the unit by removing any outlet pressure drop above their set pressure. However, these valves may comprise either an internal reference pressure chamber, or a moving sealing apparatus between the inside and the outside of the valve. Valves referenced to outlet pressure are simpler but have a certain pressure drop across the valve whenever fluids are flowing through the valve. These types of back pressure valves significantly increase the heat transfer capabilities and thus reduce the size of the vaporizer/liquid gas boiler by increasing the vaporized fluid/gas density. For example, even 100 psi of back pressure can create a large improvement with respect to the heat transfer characteristics when the outlet pressure is low (such as at the end of the purging process).

Referring again to FIG. 3, the specific embodiment utilizes pressure within liquid gas vessel 48 to deliver fluid to a liquid gas boiler 50, which also can be referred to as a vaporizer or heat exchanger. The liquid is converted to gas and delivered under pressure for performance of the purging function with respect to a desired tubing or vessel. In the example illustrated, purging gas is delivered to coiled tubing reel 32 for purging coiled tubing 30. According to one embodiment, heat for the liquid gas boiler 50 is supplied from a heat source/power source, as indicated by arrows 51, on transport unit 20. For example, heat may be supplied by the tractor 24 or by deck engine. Heat also may be supplied by well servicing fluids through appropriate fluid routing arrangements, such as with a connection to the coiled tubing 30 and/or well servicing unit 38, as will be appreciated by those skilled in the art.

In the specific embodiment illustrated, liquid gas vessel 48 is coupled to a tank vent valve 52 and to a relief valve 54, which may be constructed as a spring-loaded check valve or another suitable construction. Additionally, a pressure building coil 56 may be coupled to liquid gas vessel 48 to build pressure within vessel 48. The pressure building coil 56 may circulate air, oil, heated coolant, or other fluids across the coil, as indicated by arrows 58, to heat the fluid within the coil. Pressure building coil 56 may be coupled to liquid gas vessel 48 across a pressure building valve 60, allowing the tank pressure to be increased as needed.

As illustrated, the liquid gas vessel 48 is connected to liquid gas boiler 50 across a liquid gas shutoff valve 62 and a relief valve 63. Optionally, a flow control valve 64 also may be positioned downstream, as illustrated, or upstream of liquid gas boiler 50. In this embodiment, as liquid from liquid gas vessel 48 passes through liquid gas boiler 50, the fluid is converted to a gas and directed through a flow metering device 66. Optionally, a back pressure valve 68 may be employed to improve heat transfer characteristics, as described above.

Additionally, one or more vent/isolation valves 70 may be positioned in the flow of fluid moving to coiled tubing reel 32. In the illustrated example, valve 70 is located downstream of back pressure valve 68 and either connects the outlet of the vaporizer/liquid gas boiler 50 to atmosphere or to an outlet. Similar functions may be accomplished using multiple valves instead of a single three port valve. After flowing past the one or more isolation valves 70, the purging gas moves through a check valve 72 and subsequently through a treating valve or isolation valve 74 before being directed into coiled tubing 30 at coiled tubing reel 32. By way of example, treating valve 74 may comprise a plug type valve. Depending on the embodiment, check valve 72 and valve 74 may or may not be present; or multiples of these valves may be present.

Figure 4:
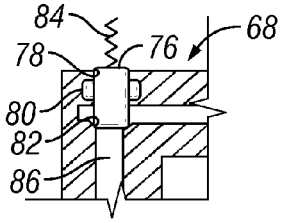
FIG. 4 illustrates one example of a back pressure valve that can be used with a gas delivery system, according to an embodiment of the present invention.

If back pressure valve 68 is used to maintain a significant pressure in liquid gas boiler 50, a variety of valve types potentially can be employed. For example, back pressure valve 68 may comprise a check valve or a plunger style valve in which a plunger is moved aside to enable flow when internal pressure reaches a predetermined set pressure. One example of a plunger style valve is illustrated in FIG. 4 as having a plunger 76 slidably mounted in a passage 78 and sealed with respect to the passage 78 via a seal 80. The plunger 76 is biased toward a seat 82, and thus a closed position, via a biasing member 84, such as a spring or a flexible gas chamber formed with a bellows or a diaphragm actuator. When sufficient internal pressure builds, plunger 76 is moved against the bias of member 84 to open a flow path along a flow passage 86. When member 84 is open, flow passage 86 enables flow through the back pressure valve 68 and subsequent components of purging system 42. The opening of flow passage 86 at back pressure valve 68 enables gas flow to downstream components, such as isolating valves 70, and ultimately to the structure to be purged, such as coiled tubing 30.

It should be noted that a variety of back pressure valve types can be utilized. For example, the back pressure valve illustrated in FIG. 4 is referenced to atmospheric pressure. If the spring area is connected to the outlet end of passage 86, the valve becomes a simple spring-loaded check valve. If the plunger is replaced with a bellows or a diaphragm biased toward the closed position with a specified charge pressure behind it, then the set pressure is simply the absolute charge pressure. Other types of back pressure valves 68 also can be employed.

Figure 5:
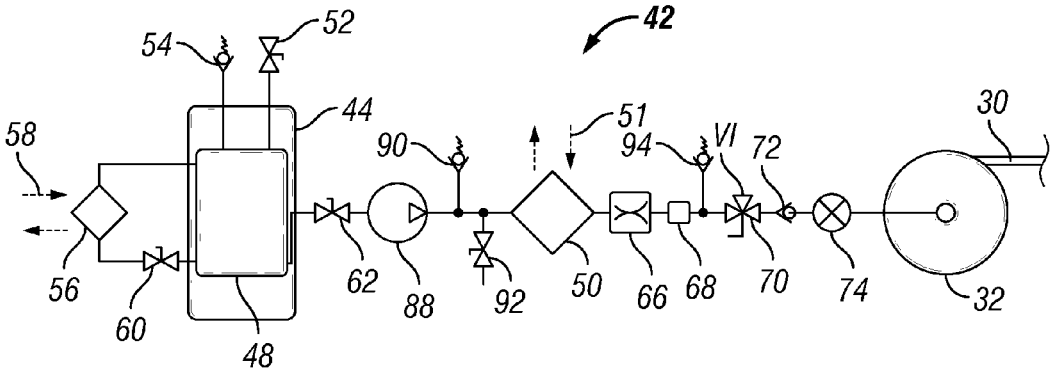
FIG. 5 is a schematic illustration of another embodiment of a gas delivery system that can be incorporated into the transport unit, according to an embodiment of the present invention.

An embodiment of purging system 42 is illustrated in FIG. 5. In this embodiment the flow of fluid to liquid gas boiler 50 does not rely on the pressure within liquid gas vessel 48 and allows the use of lower pressure tanks if desired. Additionally, this arrangement allows for much higher delivery pressures, limited only by the rating of a pump 88, described below. For example, the one or more liquid gas vessels 48 can be pressurized to a much lower pressure, e.g. 30 to 60 psi. Instead of relying on the pressure of liquid gas vessel 48, the liquid output from vessel 48 is fed to pump 88, e.g. a hydraulic or air driven cryogenic gas pump. Pump 88 potentially makes the system suitable for delivering gas at well treatment pressures. The pump 88 may be powered by any suitable power source including, but not limited to, the engine of the tractor 24 and/or the deck engine. The power source may be, but is not limited to, a hydraulic or pneumatic power source that may be shared with other functions performed and/or systems utilized by the well servicing unit 38. Additionally, for the case where the tank pressure less the opening pressure (opening pressure of the internal check valves in the pump, delivery check valve 72, and the back pressure valve) is lower than the pressure at the outlet of valve 74, then the amount of liquid gas delivered by the pump may be approximated by counting the number of pump strokes.

Depending on the requirements of a well servicing operation and/or the requirements for pumping or purging, several types of pumps 88 can be employed to facilitate transfer of purging fluid. For example, pump 88 may comprise a centrifugal pump such as a magnetically driven centrifugal pump operating in cooperation with a control valve. In other applications, plunger pumps, such as, but not limited to, variable displacement plunger pumps or the like, having fewer than three plungers can be used alone or in cooperation with a centrifugal pump. With lower flow rates, for example, a small, light single plunger pump can be employed. Often, the pulsating flow produced by the single plunger pump enhances heat transfer in the liquid gas boiler 50. The volume of the liquid gas boiler/vaporizer 50 generally is large enough to significantly attenuate the pressure pulsations of even a single plunger pump. In some applications, the plunger pump may be designed such that a portion, e.g. the pump head, is disposed inside the liquid gas vessel 48 to facilitate cooling of the pump and to eliminate the need for cooling down the pump head before pumping.

In other applications, pump 88 comprises a plural plunger pump in which two or more plungers are used to move fluid discharged from vessel 48. In many applications, plunger pumps can be used in cooperation with liquid gas vessels 48 that are pressurized to at least 30 psi. However, lower pressures can sometimes be used if pump 88 is constructed as a boosted plunger pump.

Referring again to FIG. 5, the embodiment of purging system 42 incorporating pump 88 may utilize many of the same components described in the embodiment of FIG. 3, and those components are labeled with similar reference numerals. As illustrated, pump 88 is positioned downstream of liquid gas shutoff valve 62. Liquid discharged from pump 88 passes a liquid relief valve 90, such as a check valve or burst disc, and then flows past a liquid vent valve 92 for cool down and priming. The liquid then flows into liquid gas boiler 50. In the case where the tank pressure is high enough to open the internal check valves of the pump and the back pressure valve 68, the cool down and priming function may be accomplished by using vent valve 70 instead.

The fluid, e.g. gas, discharged from liquid gas boiler 50 passes through an optional flow metering device 66 and through optional back pressure valve 68. The gas then moves past a high pressure, gas relief valve 94 before moving through the one or more isolation valves 70. After flowing past isolation valves 70, the purging gas moves through check valve 72 and subsequently through treating valve 74 before being directed into coiled tubing 30 at coiled tubing reel 32.

The gas delivery systems 42 can be designed in many configurations with a variety of components depending on the desired operational characteristics to enable given pumping and/or purging applications, including pumping a treatment fluid downhole. For example, many types of liquid gas pressure vessels, pumps, heat exchangers, valves, and other components can be used to enable purging of coiled tubing and/or other types of pipes or vessels. Furthermore, the size, number and configuration of components can vary according to the type of integrated transport unit employed to integrate the various systems for specific well servicing applications. For example, the size and weight of purging system 42 may be constrained by weight restrictions on transport vehicles used to traverse public roadways.

By way of example, weight restrictions that must be met to enable legal travel over a public roadway may encourage construction of a lightweight purging system 42. Some systems can be designed with the components described above at a weight of less than 1000 pounds while remaining capable of providing high pressure fluid, e.g. nitrogen, at up to 15,000 psi and at a flow rate of up to 5400 scf. In such applications, flow rates compatible with the horsepower available on, for example, a coiled tubing unit can provide enough flow for smaller foam cleanouts and kickoffs in addition to purging the coiled tubing. Accordingly, the integrated systems can be employed to perform a variety of functions which further increases the efficiency of the overall integrated transport unit. Similarly, a system installed on a cementing unit may take advantage of the engine horsepower and available waste heat and/or process water heat to provide nitrogen for a foamed cement job.

Accordingly, although only a few embodiments have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in coiled tubing services, comprising:

at least one transport vehicle having a weight within the legal limits required for use on a public road system, the at least one transport vehicle comprising:

a reel of coiled tubing; and a gas delivery system to deliver high pressure gas, the gas delivery system comprising a gas vessel and a purging system comprising a pressure controlled back pressure valve to purge fluid from the coiled tubing, upon completion of a well operation, to remove weight and to enable transport along the public road system.

2. The system as recited in claim 1, wherein the gas delivery system is able to deliver pressurized gas through the coiled tubing when the coiled tubing is deployed in a well.

3. The system as recited in claim 1, wherein the gas delivery system comprises a cryogenic gas vessel and a pressure building coil coupled to the cryogenic gas vessel.

4. The system as recited in claim 3, wherein the gas delivery system comprises a liquid gas boiler coupled to the cryogenic gas vessel.

5. The system as recited in claim 4, wherein the liquid gas boiler utilizes waste heat from an engine on the transport vehicle.

6. The system as recited in claim 4, wherein the liquid gas boiler utilizes heat from well servicing fluids.

7. The system as recited in claim 4, wherein the purging system comprises a liquid gas pump coupled to the cryogenic gas vessel and the liquid gas boiler.

8. The system as recited in claim 4, wherein the back pressure valve is adapted to maintain a desired pressure in the liquid gas boiler.

9. A method, comprising:

providing at least one transportable structure;

mounting a coiled tubing reel with coiled tubing on the at least one transportable structure;

positioning a well servicing unit on the at least one transportable structure in cooperation with the coiled tubing; and locating a purging system on the at least one transportable structure;

purging a fluid from the coiled tubing, upon completion of a well operation, to remove weight and to enable transport along the public road system.

10. The method as recited in claim 9, wherein positioning comprises positioning a well cementing unit.

11. The method as recited in claim 9, wherein positioning comprises positioning a coiled tubing unit.

12. The method as recited in claim 9, wherein positioning comprises positioning a fracturing system.

13. The method as recited in claim 9, further comprising delivering a gas at high pressure for performing at least one well services operation.

14. The method as recited in claim 9, wherein locating comprises locating a heat exchanger and a pressure building coil coupled to a cryogenic gas vessel.

15. The method as recited in claim 14, wherein locating further comprises locating a back pressure valve coupled to the cryogenic gas vessel to maintain a desired pressure in the heat exchanger.

16. The system as recited in claim 14, wherein the heat exchanger utilizes heat from well servicing fluids.

17. The method as recited in claim 14, wherein locating comprises locating a purging system comprising a plurality of cryogenic gas vessels to enable refilling of a cryogenic gas vessel while another cryogenic gas vessel is used to purge fluid.

18. The method as recited in claim 9, further comprising:

forming the at least one transportable structure as part of a transport vehicle for use on a public road system; and maintaining the gross weight of the at least one transport vehicle, with coiled tubing reel, coiled tubing, well servicing unit and purging system, under the weight limits of the public road system.

* * * * *